United States Patent [19]

Mandel et al.

[11] 4,149,614

[45] Apr. 17, 1979

[54] ELEVATOR SYSTEM

[75] Inventors: Alan F. Mandel, Scott Township, Allegheny County; Charles L. Winkler, Worthington, both of Pa.

[73] Assignee: Westinghouse Electric Corp., Pittsburgh, Pa.

[21] Appl. No.: 796,497

[22] Filed: May 12, 1977

[51] Int. Cl.[2] ..... B66B 3/00

[52] U.S. Cl. ..... 187/29 R; 340/19 R

[58] Field of Search ..... 187/29; 340/19–21

[56] References Cited

U.S. PATENT DOCUMENTS

| | | | |
|---|---|---|---|
| 2,372,348 | 3/1945 | White et al. | 340/19 |
| 3,740,709 | 6/1973 | Savino | 340/21 |
| 3,903,499 | 9/1975 | Oliver | 187/29 |
| 3,973,648 | 8/1976 | Hummert et al. | 187/29 |

*Primary Examiner*—James R. Scott

*Assistant Examiner*—W. E. Duncanson, Jr.

*Attorney, Agent, or Firm*—D. R. Lackey

[57] ABSTRACT

An elevator system including at least one elevator car mounted for movement in a building to serve the floors therein, and pushbuttons for entering calls for elevator service. Calls for elevator service initiated by the pushbuttons are visually displayed in a predetermined order on a display in which the display positions for such calls are not specifically related to a specific floor, but which may be used to indicate a call associated with any floor of the building. In a preferred embodiment, the calls are stacked or compressed to provide a predetermined uniform physical spacing between adjacent calls of the predetermined order. The predetermined order and predetermined spacing are maintained as new calls are entered on the display, and answered calls are deleted therefrom.

20 Claims, 11 Drawing Figures

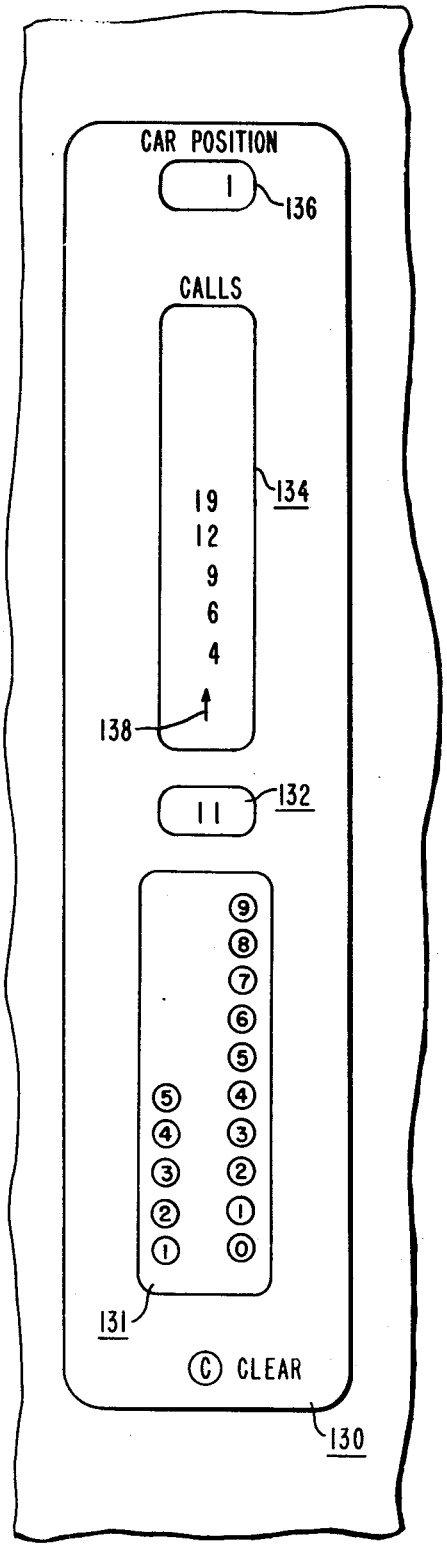
FIG. 7
FIG. 8
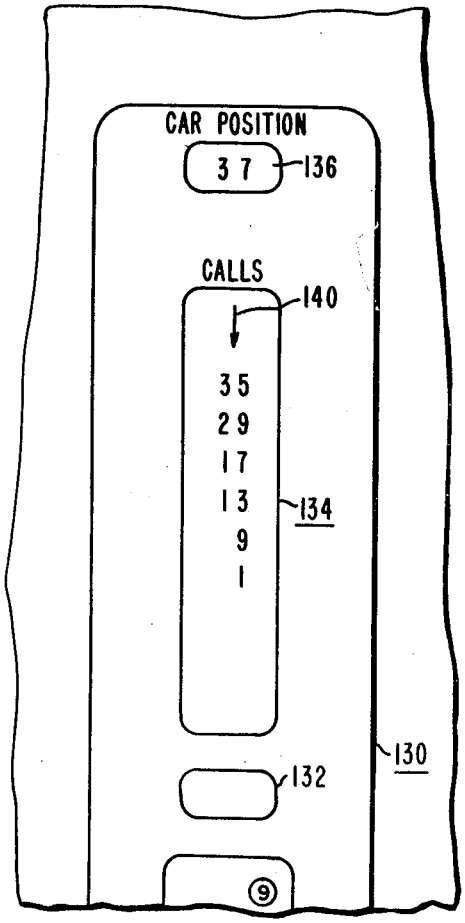
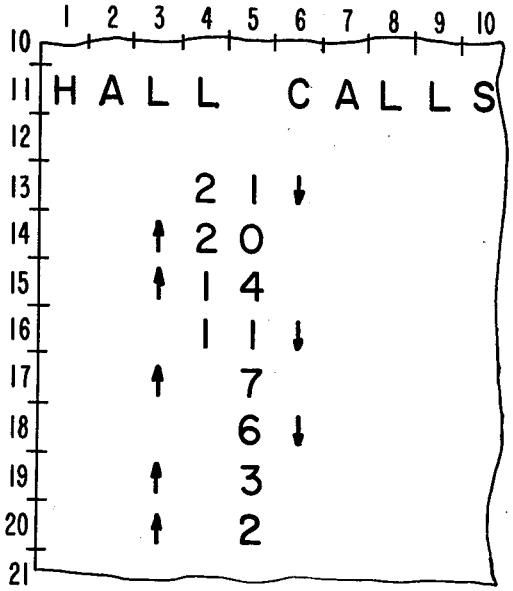
FIG. 3A

| ROM MAP | | RAM MAP | | | | | | | | | | |
|---|---|---|---|---|---|---|---|---|---|---|---|---|
| LOOK UP TABLE | | HALL CALLS | | CAR CALLS | | | | CAR STATUS SIGNALS | | | | |
| SCAN SLOT | FLOOR | UP | DOWN | A | B | C | D | SYMBOLS | A | B | C | D |
| 31 | | 0 | 0 | 0 | 0 | 0 | 0 | | | | | |
| 30 | TE | 0 | 0 | 0 | 1 | 0 | 0 | | | | | |
| 29 | | 0 | 0 | 0 | 0 | 0 | 0 | | | | | |
| 28 | 24 | 0 | 0 | 0 | 0 | 0 | 0 | | | | | |
| 27 | 23 | 0 | 0 | 0 | 0 | 0 | 0 | | | | | |
| 26 | 22 | 0 | 0 | 0 | 1 | 0 | 1 | | | | | |
| 25 | 21 | 0 | 1 | 0 | 0 | 0 | 0 | | | | | |
| 24 | 20 | 1 | 0 | 0 | 1 | 0 | 0 | | | | | |
| 23 | | 0 | 0 | 0 | 0 | 0 | 0 | | | | | |
| 22 | 19 | 0 | 0 | 0 | 0 | 0 | 1 | | | | | |
| 21 | 18 | 0 | 0 | 0 | 0 | 0 | 0 | $\overline{WT75}$ | 0 | 0 | 0 | 0 |
| 20 | 17 | 0 | 0 | 0 | 0 | 0 | 1 | $\overline{WT50}$ | 0 | 0 | 0 | 0 |
| 19 | 16 | 0 | 0 | 0 | 0 | 0 | 0 | CREG | 1 | 1 | 1 | 1 |
| 18 | 15 | 0 | 0 | 0 | 0 | 0 | 0 | ATSV | 0 | 0 | 0 | 0 |
| 17 | | 0 | 0 | 0 | 0 | 0 | 0 | AVP6 | 0 | 0 | 0 | 0 |
| 16 | 14 | 1 | 0 | 0 | 0 | 0 | 0 | AVP5 | 0 | 0 | 0 | 0 |
| 15 | 13 | 0 | 0 | 0 | 0 | 0 | 0 | AVP4 | 0 | 1 | 0 | 0 |
| 14 | 12 | 0 | 0 | 0 | 0 | 0 | 0 | AVP3 | 1 | 0 | 0 | 0 |
| 13 | 11 | 0 | 1 | 0 | 0 | 0 | 0 | AVP2 | 1 | 0 | 1 | 0 |
| 12 | 10 | 0 | 0 | 0 | 0 | 0 | 0 | AVP1 | 0 | 1 | 1 | 0 |
| 11 | | 0 | 0 | 0 | 0 | 0 | 0 | AVP0 | 0 | 1 | 1 | 1 |
| 10 | 9 | 0 | 0 | 0 | 0 | 0 | 0 | AVAS | 0 | 0 | 0 | 0 |
| 9 | 8 | 0 | 0 | 0 | 0 | 0 | 0 | $\overline{32L}$ | 0 | 1 | 0 | 1 |
| 8 | 7 | 1 | 0 | 1 | 0 | 0 | 0 | DRCL | 1 | 0 | 1 | 0 |
| 7 | 6 | 0 | 1 | 0 | 0 | 0 | 0 | CCBL | 1 | 0 | 1 | 0 |
| 6 | 5 | 0 | 0 | 0 | 0 | 1 | 0 | CCAB | 0 | 1 | 0 | 1 |
| 5 | | 0 | 0 | 0 | 0 | 0 | 0 | CALL | 1 | 1 | 1 | 1 |
| 4 | 4 | 0 | 0 | 0 | 0 | 1 | 0 | UPSV | 0 | 1 | 0 | 1 |
| 3 | 3 | 1 | 0 | 1 | 0 | 0 | 0 | UPTR | 0 | 1 | 0 | 1 |
| 2 | 2 | 1 | 0 | 0 | 0 | 0 | 0 | $\overline{INSC}$ | 0 | 0 | 0 | 0 |
| 1 | 1 | 0 | 0 | 1 | 0 | 1 | 0 | BYPS | 0 | 0 | 0 | 0 |
| 0 | B | 0 | 0 | 1 | 0 | 0 | 0 | SLDN | 1 | 0 | 1 | 0 |

FIG. 5

RAM MAP

UP HALL CALLS

| MONITOR ADDRESS - LEFT BIT | | | | | | | | | | | | MONITOR DATA - LEFT BIT | | | | | | | | MONITOR ADDRESS - RIGHT BIT | | | | | | | | | | | | MONITOR DATA - RIGHT BIT | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|
| ROW | | | | | COLUMN | | | | | | | MODE | | ROW | | | COLUMN | | | | ROW | | | | | COLUMN | | | | | | | MODE | | ROW | | | COLUMN | | | |
| A11 | A10 | A9 | A8 | A7 | A6 | A5 | A4 | A3 | A2 | A1 | A0 | D8 | D7 | D6 | D5 | D4 | D3 | D2 | D1 | D0 | A11 | A10 | A9 | A8 | A7 | A6 | A5 | A4 | A3 | A2 | A1 | A0 | D8 | D7 | D6 | D5 | D4 | D3 | D2 | D1 | D0 |
| 0 | 1 | 1 | 0 | 1 | 0 | 0 | 0 | 0 | 1 | 0 | 1 | 0 | 0 | 0 | 1 | 1 | 0 | 0 | 1 | 0 | 0 | 1 | 1 | 0 | 1 | 0 | 0 | 0 | 0 | 1 | 1 | 0 | 0 | 0 | 0 | 1 | 1 | 0 | 0 | 0 | 0 |
| 0 | 1 | 1 | 1 | 0 | 0 | 0 | 0 | 0 | 1 | 0 | 1 | 0 | 0 | 0 | 1 | 1 | 0 | 0 | 0 | 1 | 0 | 1 | 1 | 1 | 0 | 0 | 0 | 0 | 0 | 1 | 1 | 0 | 0 | 0 | 0 | 1 | 1 | 0 | 1 | 0 | 0 |
| 0 | 1 | 1 | 1 | 1 | 0 | 0 | 0 | 0 | 1 | 0 | 1 | 0 | 0 | 0 | 1 | 0 | 0 | 0 | 0 | 0 | 0 | 1 | 1 | 1 | 1 | 0 | 0 | 0 | 0 | 1 | 1 | 0 | 0 | 0 | 0 | 1 | 1 | 0 | 1 | 1 | 1 |
| 1 | 0 | 0 | 0 | 0 | 0 | 0 | 0 | 0 | 1 | 0 | 1 | 0 | 0 | 0 | 1 | 0 | 0 | 0 | 0 | 0 | 1 | 0 | 0 | 0 | 0 | 0 | 0 | 0 | 0 | 1 | 1 | 0 | 0 | 0 | 0 | 1 | 1 | 0 | 0 | 1 | 1 |
| 1 | 0 | 0 | 0 | 1 | 0 | 0 | 0 | 0 | 1 | 0 | 1 | 0 | 0 | 0 | 1 | 0 | 0 | 0 | 0 | 0 | 1 | 0 | 0 | 0 | 1 | 0 | 0 | 0 | 0 | 1 | 1 | 0 | 0 | 0 | 0 | 1 | 1 | 0 | 0 | 1 | 0 |
| 1 | 0 | 0 | 1 | 0 | 0 | 0 | 0 | 0 | 1 | 0 | 1 | | | | | | | | | | 1 | 0 | 0 | 1 | 0 | 0 | 0 | 0 | 0 | 1 | 1 | 0 | | | | | | | | | |
| 1 | 0 | 0 | 1 | 1 | 0 | 0 | 0 | 0 | 1 | 0 | 1 | | | | | | | | | | 1 | 0 | 0 | 1 | 1 | 0 | 0 | 0 | 0 | 1 | 1 | 0 | | | | | | | | | |
| 1 | 0 | 1 | 0 | 0 | 0 | 0 | 0 | 0 | 1 | 0 | 1 | | | | | | | | | | 1 | 0 | 1 | 0 | 0 | 0 | 0 | 0 | 0 | 1 | 1 | 0 | | | | | | | | | |
| 1 | 0 | 1 | 0 | 1 | 0 | 0 | 0 | 0 | 1 | 0 | 1 | | | | | | | | | | 1 | 0 | 1 | 0 | 1 | 0 | 0 | 0 | 0 | 1 | 1 | 0 | | | | | | | | | |
| 1 | 0 | 1 | 1 | 0 | 0 | 0 | 0 | 0 | 1 | 0 | 1 | | | | | | | | | | 1 | 0 | 1 | 1 | 0 | 0 | 0 | 0 | 0 | 1 | 1 | 0 | | | | | | | | | |
| 1 | 0 | 1 | 1 | 1 | 0 | 0 | 0 | 0 | 1 | 0 | 1 | | | | | | | | | | 1 | 0 | 1 | 1 | 1 | 0 | 0 | 0 | 0 | 1 | 1 | 0 | | | | | | | | | |

DOWN HALL CALLS

| | | | | | | | | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|
| 0 | 1 | 1 | 0 | 1 | 0 | 0 | 0 | 1 | 1 | 1 | 0 | 0 | 0 | 0 | 1 | 1 | 0 | 0 | 1 | 0 | 0 | 1 | 1 | 0 | 1 | 0 | 0 | 0 | 1 | 1 | 1 | 1 | 0 | 0 | 0 | 1 | 1 | 0 | 0 | 0 | 1 |
| 0 | 1 | 1 | 1 | 0 | 0 | 0 | 0 | 1 | 1 | 1 | 0 | 0 | 0 | 0 | 1 | 1 | 0 | 0 | 0 | 1 | 0 | 1 | 1 | 1 | 0 | 0 | 0 | 0 | 1 | 1 | 1 | 1 | 0 | 0 | 0 | 1 | 1 | 0 | 0 | 0 | 1 |
| 0 | 1 | 1 | 1 | 1 | 0 | 0 | 0 | 1 | 1 | 1 | 0 | 0 | 0 | 0 | 1 | 0 | 0 | 0 | 0 | 0 | 0 | 1 | 1 | 1 | 1 | 0 | 0 | 0 | 1 | 1 | 1 | 1 | 0 | 0 | 0 | 1 | 1 | 0 | 1 | 1 | 0 |
| 1 | 0 | 0 | 0 | 0 | 0 | 0 | 0 | 1 | 1 | 1 | 0 | | | | | | | | | | 1 | 0 | 0 | 0 | 0 | 0 | 0 | 0 | 1 | 1 | 1 | 1 | | | | | | | | | |
| 1 | 0 | 0 | 0 | 1 | 0 | 0 | 0 | 1 | 1 | 1 | 0 | | | | | | | | | | 1 | 0 | 0 | 0 | 1 | 0 | 0 | 0 | 1 | 1 | 1 | 1 | | | | | | | | | |
| 1 | 0 | 0 | 1 | 0 | 0 | 0 | 0 | 1 | 1 | 1 | 0 | | | | | | | | | | 1 | 0 | 0 | 1 | 0 | 0 | 0 | 0 | 1 | 1 | 1 | 1 | | | | | | | | | |
| 1 | 0 | 0 | 1 | 1 | 0 | 0 | 0 | 1 | 1 | 1 | 0 | | | | | | | | | | 1 | 0 | 0 | 1 | 1 | 0 | 0 | 0 | 1 | 1 | 1 | 1 | | | | | | | | | |
| 1 | 0 | 1 | 0 | 0 | 0 | 0 | 0 | 1 | 1 | 1 | 0 | | | | | | | | | | 1 | 0 | 1 | 0 | 0 | 0 | 0 | 0 | 1 | 1 | 1 | 1 | | | | | | | | | |
| 1 | 0 | 1 | 0 | 1 | 0 | 0 | 0 | 1 | 1 | 1 | 0 | | | | | | | | | | 1 | 0 | 1 | 0 | 1 | 0 | 0 | 0 | 1 | 1 | 1 | 1 | | | | | | | | | |
| 1 | 0 | 1 | 1 | 0 | 0 | 0 | 0 | 1 | 1 | 1 | 0 | | | | | | | | | | 1 | 0 | 1 | 1 | 0 | 0 | 0 | 0 | 1 | 1 | 1 | 1 | | | | | | | | | |
| 1 | 0 | 1 | 1 | 1 | 0 | 0 | 0 | 1 | 1 | 1 | 0 | | | | | | | | | | 1 | 0 | 1 | 1 | 1 | 0 | 0 | 0 | 1 | 1 | 1 | 1 | | | | | | | | | |

FIG. 6

ELEVATOR SYSTEM

BACKGROUND OF THE INVENTION

1. Field of the Invention:

The invention relates in general to elevator systems, and more specifically to elevator systems which include a visual display for indicating the existence of predetermined calls for elevator service, and the floor associated with each call.

2. Description of the Prior Art:

Elevator systems of the prior art conventionally include pushbuttons in the hallways of the floors for registering up and down hall calls, and pushbuttons in each elevator car for a passenger to indicate the desired destination floor after the car has stopped to admit the prospective passenger in response to a hall call. A lamp associated with each hall call pushbutton and each car call pushbutton is energized when the associated pushbutton is actuated, to signify that a call has been entered, and the lamp remains energized until the call is answered or served. For example, a reset signal may be generated to deenergize the lamp when the elevator car initiates slowdown in its preparation to stop at the floor associated with the call.

Registered up and down hall calls, and/or car calls registered in each car, may also be displayed remotely from the pushbuttons, such as at a traffic director station located in the lobby. A lamp is provided on this display panel for each call to be displayed. The proper lamp is energized when a call is entered, and it is deenergized when the call is answered or served.

SUMMARY OF THE INVENTION

Briefly, the present invention is a new and improved elevator system which includes a new and improved display for displaying destination or car calls, whether generated in a hallway, or in an elevator car, and/or for displaying up and down hall calls. Instead of requiring a lamp for each call to be displayed, the display includes a plurality of display positions, with the number of display positions being unrelated to the maximum possible number of such calls. In other words, each display position is not permanently associated with any specific floor, but may be used to signify a call at any selected floor by displaying the letters or numbers associated with the selected floor at this position. Each position may be an addressable location on a video monitor, a segmented display device, such as the popular 7-segment LED display, or any other addressable display.

The calls are displayed in a predetermined order. If the display is associated with car calls, and the display is located within the elevator car, the car calls are preferably displayed in the order in which they will be served by the elevator car. If the display is a remote display for hall calls, and/or car calls, the calls are displayed in the order in which their associated floors appear in the building.

In addition to displaying the calls in a predetermined order, in the preferred embodiment of the invention they are also stacked or "compressed" to provide a predetermined uniform physical spacing between adjacent displayed calls, which spacing is not proportional to the actual spacing between the floors associated with adjacent displayed calls.

The display is preferably updated on a periodic basis, such as every two seconds, to include newly registered calls, and to delete answered calls. Each updating of the display conforms with the selected predetermined order and selected predetermined physical spacing between the displayed calls.

BRIEF DESCRIPTION OF THE DRAWING

The invention may be better understood, and further advantages and uses thereof more readily apparent, when considered in view of the following detailed description of exemplary embodiments, taken with the accompanying drawings in which:

FIG. 3A is a fragmentary view of the video monitor shown in FIG. 3, illustrating the display of hall calls according to another embodiment of the invention;

FIGS. 5 and 6 illustrate RAM maps illustrative of the storage of raw and processed data, respectively, in the RAMs of FIG. 1; and FIGS. 7, 8, 9 and 10 are fragmentary views of display panels constructed according to still other embodiments of the invention.

DESCRIPTION OF PREFERRED EMBODIMENTS

Figure 1:
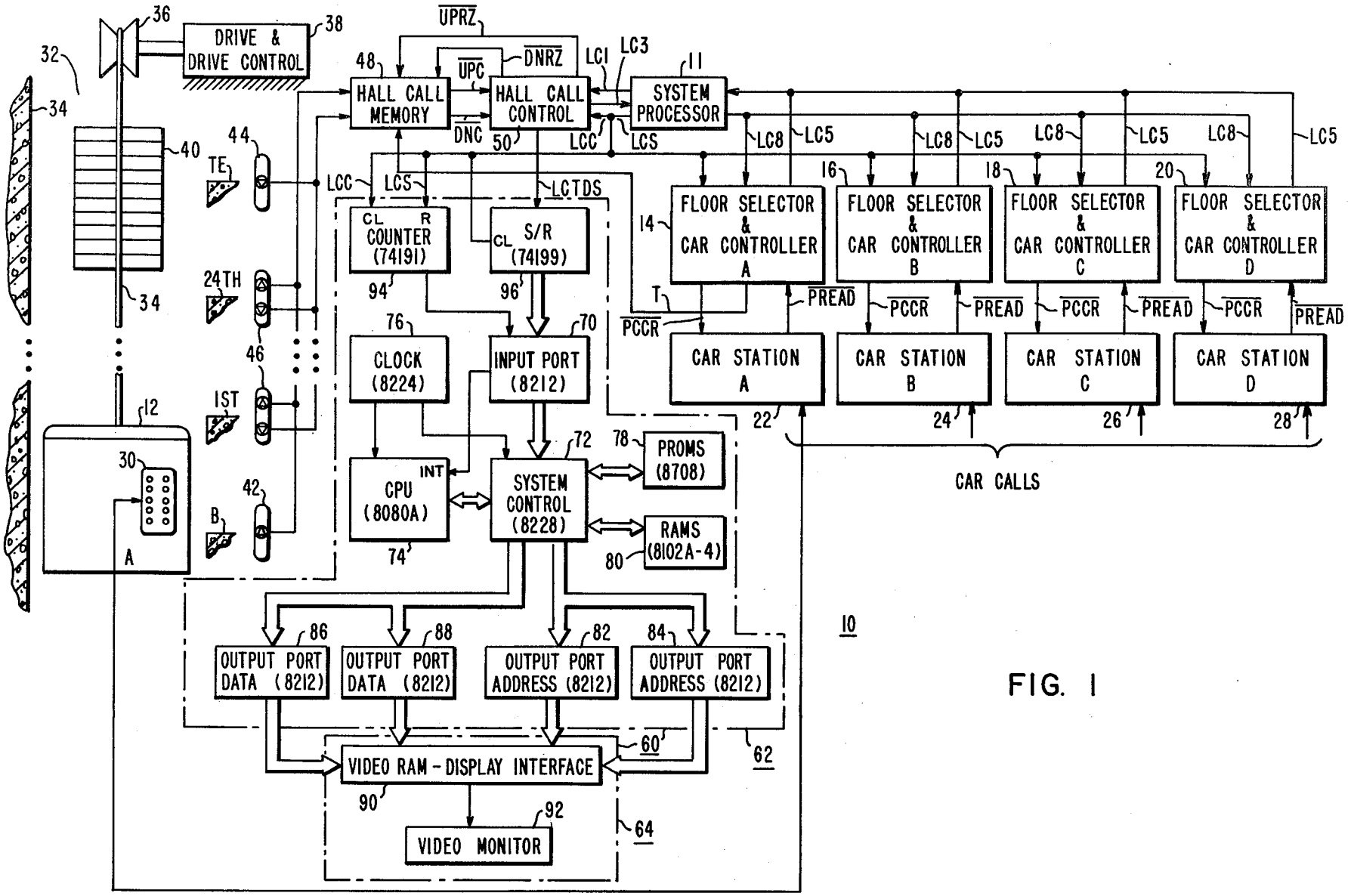
FIG. 1 is a diagrammatic view of an elevator system constructed according to the teachings of the invention.

Referring now to the drawings, and to FIG. 1 in particular, there is shown an elevator system 10 constructed according to the teachings of the invention. In order to limit the complexity of the present application, the following United States patents, which are assigned to the same assignee as the present application, are hereby incorporated by reference. These United States patents describe in detail an elevator system which may utilize the teachings of the invention, and thus FIG. 1 illustrates these functions in block form:

(1) U.S. Pat. No. 3,750,850
(2) U.S. Pat. No. 3,804,209
(3) U.S. Pat. No. 3,851,733

Elevator system 10 includes a plurality of elevator cars under the control of a supervisory system processor 11. For purposes of example, the controls A, B, C, and D for four elevator cars are illustrated, with only an elevator car 12, associated with control A, being illustrated, since the others would be similar. The elevator controls A, B, C and D each include a floor selector and car controller 14, 16, 18 and 20, respectively, mounted remotely from the associated car, such as in the machine room, and they each include car stations 22, 24, 26 and 28, respectively, mounted in the associated elevator car. Each of the car stations includes a pushbutton array, such as pushbutton array 30 illustrated in elevator car 12, for passengers to register car calls, i.e., their destination floors. The car calls are serialized in the car station and sent to the associated floor selector as signal PREAD. Car call resets are sent from the floor selector to the car station as serial signal PCCR.

The elevator cars are mounted for movement in a building to serve the floors therein. For example, car 12 is mounted in a hoistway 32 of a building 34 having a plurality of floors or landings. For purposes of example, it will be assumed that building 34 has twenty-six floors, with only the lowest floor B, the highest floor TE, and intermediate floors 1 and 24, being shown in FIG. 1.

The car 12 is supported by a plurality of wire ropes 34 which are reeved over a traction sheave 36 mounted on the shaft of a drive motor 38. Drive motor 38 also includes suitable controls, shown generally within block 38. A counterweight 40 is connected to the other ends of the ropes 34. A traction elevator system is illustrated in FIG. 1 for purposes of example, but it is to be understood that the invention applies equally to any type of elevator system, such as an elevator system which is hydraulically operated.

Hall calls are registered by pushbuttons mounted in the hallways adjacent to the floor openings to the hoistway. For example, the lowest floor B includes an up pushbutton 42, the highest floor TE includes a down pushbutton 44, and the intermediate floors each include up and down pushbutton assemblies 46. The up and down hall calls registered on these pushbuttons are sent to a hall call memory 48 where they are serialized and sent to hall call control 50 as signals $\overline{UPC}$ and $\overline{DNC}$, respectively.

Hall call control 50 sends the hall calls to the system processor 11 as part of serial signal LC1. The system processor 11 prepares assignments for the various elevator cars and sends individual assignment words to each car controller and floor selector via signals LC8. Each car controller and floor selector prepares status words for the system processor 11, which are sent to the system processor as signals LC5. The system processor 11 prepares reset signals for the hall call control and sends the resets to the hall call control as part of a signal LC3. Hall call control 50 sends up and down resets $\overline{UPRZ}$ and $\overline{DNRZ}$, respectively, to the hall call memory 48. Clock and synchronization signals LCC and LCS, respectively, are prepared by the system processor 11 and sent to the various control functions, to properly control transfer of data between the functional blocks. The incorporated patents explain the timing and the makeup of the various serial signals in detail.

FIG. 1 illustrates an embodiment of the invention in which hall calls registered on pushbuttons 42, 44 and 46 at the various floors are displayed at a selected location, such as at a traffic director station 60, hereinafter referred to as TDS 60, located in the lobby or the main floor. For purposes of example, TDS 60 includes a microprocessor 62 and a video display 64. It is to be understood, however, that the display 64 may be any suitable type of display, such as light emitting diodes (LEDs), liquid crystals, and the like. Further, the processing portion of the display may be hardwired logic, instead of using a microprocessor. The microprocessor 62 and video display 64 is an attractive combination as it facilitates the use of TDS 60 as an universal message center for the building 34, which may be easily tied into the building security system.

For purposes of example, the microprocessor 62 will be assumed to be Intel's 8080, but any suitable microprocessor or digital computer may be used. Microprocessor 62 includes an input port 70, (Intel's 8212), a system controller 72 (Intel's 8228), a central processor or CPU 74 (Intel's 8080A), a clock generator 76 (Intel's 8224), a read only memory 78, also referred to as ROM 78 (Intel's 8708), a random access memory 80, also referred to as RAM 80 (Intel's 8102A-4), and output ports 82, 84, 86 and 88 (Intel's 8212). In the elevator system of the incorporated patents, the data for TDS 60 would be sent over a serial data link, which is referenced LCTDS. This serial data may be demultiplexed eight bits at a time for entry into input port 70 via a counter 94 (Texas Instruments SN 74191) and a shift register 96 (Texas Instruments SN 74199). Counter 94 is reset by a synchronization signal LCS from the system processor 11, and clocked via a clock signal LCC from the system processor. The clock signal LCC also clocks the shift register to clock the serial data contained in signal LCTDS into the eight bit shift register 96. Each time counter 94 reaches a count of 8, it outputs a signal to input port 70 which provides an interrupt signal for CPU 74, to notify the CPU that the input port should be read. The eight bits of input data are then transferred to predetermined addresses in RAM 80. The information in RAM 80 is processed according to a program stored in ROM 78, and the resulting information is stored in RAM 80 until it is ready to be read out to the video display via the output ports 82, 84, 86 and 88. If the program for the microprocessor allows sufficient time, the demultiplexing function may be performed entirely within the microprocessor, in which event the shift register 96 and counter 94 would not be required.

Figure 2:
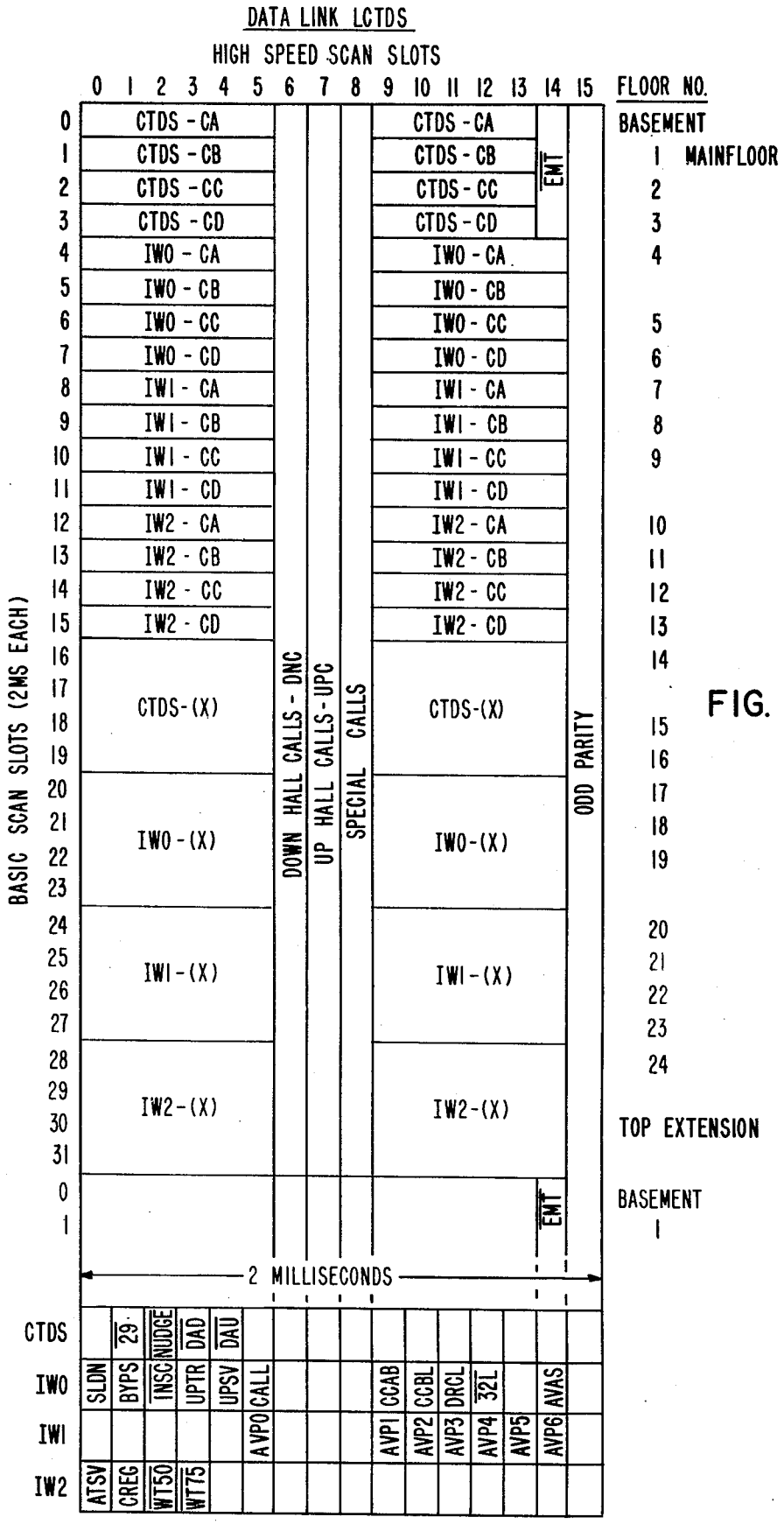
FIG. 2 is a graph which illustrates the information transferred in a data link shown in FIG. 1, between certain control functions of the elevator system and the display function.

FIG. 2 illustrates a data link map for the data link LCTDS which links hall call control 50 and shift register 96. The data link map illustrates basic timing scan slots vertically along the lefthand side, which scan slots are developed by a scan slot counter output SOS-S6S in the elevator system incorporated by reference. The subdivision of each of the basic scan slots is shown horizontally under the heading, "High Speed Scan Slots".

For purposes of example, it will be assumed that each of the basic scan slots exists for two milliseconds. Each basic scan slot is divided into sixteen bits by the high speed scan.

Each floor of the building to be served by the elevator system is assigned to one of the basic scan slots. The number of floors plus the number of scan slots required to identify express zones, and the like, determines how high the scan counter should be programmed to count before resetting to zeroes. For purposes of example, it will be assumed that the data link map is associated with a structure having twenty-six floor levels, which includes a basement floor B, floors numbered 1 through 24, and a top extension floor TE. Thus, the scan counter may be programmed to count from 0 to 31 in binary before resetting, which provides six scan slots which may be used for express zone information, or other uses. Each of the floors of the structure is assigned a binary address of the scan counter. When the scan counter is outputting the address of a specific floor, a car call for that specific floor will appear in that basic scan slot. During the same address of the specific floor, the high speed scan wil output a plurality of bits of information relative to this same floor. Thus, when the scan counter output is 01001, scan slot 9, which in the example of FIG. 2, is the binary address of the eighth floor, data concerning the eighth floor is transmitted over both the low speed and high speed time multiplex links.

Data for the traffic director station 60 may include car status data in certain of the high speed scan slots, such as slots 0 through 5 and 9 through 14, one of the slots may be used to check parity, such as slot 15, and certain of the slots may be used for down hall calls $\overline{DNC}$, up hall calls $\overline{UPC}$, and special calls, such as slots 6, 7 and 8, respectively. Thus, when the basic scan slot 9 exists, a down hall call $\overline{DNC}$ for the eighth floor will appear in the sixth high speed scan slot, and an up hall call $\overline{UPC}$ for the eighth floor will appear in the seventh high speed scan slot. Special calls, such as those from the top extension and basement, may appear in high speed scan slot 8, during the appropriate basic scan slot.

Exemplary data words which may be sent to TDS 60 for display are illustrated at the bottom of the data link map LCTDS shown in FIG. 2. The per car data may include the three input data words IW0, IW1 and IW2 prepared by each car controller for transmission to the system processor 11, and an additional data word CTDS. Data words CTDS for cars A, B, C and D may be sent during basic scan slots 0, 1, 2 and 3. In like manner, the first input data word IW0 from the four cars may be sent during the four basic scan slots 4, 5, 6 and 7. The second input data word IW1 may be sent during the next four basic scan slots 8, 9, 10 and 11, and the third input data word IW2 may be sent during the four basic scan slots 12, 13, 14 and 15. The data words are then repeated in the same order.

The signals in the data words shown in FIG. 2, and the information they convey, are tabulated below:

| SIGNAL | FUNCTION |
|---|---|
| ATSV | Car on attendant service |
| AVAS | Car is available for assignment |
| AVP0–AVP6 | Advanced car positioned in binary |
| BYPS | Car is bypassing hall calls |
| CALL | A car call is registered |
| CCAB | A car call exists above the car position |
| CCBL | A car call exists below the car position |
| $\overline{CREG}$ | A car cell has been registered |
| $\overline{DAD}$ | Car direction indicator-down |
| $\overline{DAU}$ | Car direction indicator-up |
| DRCL | True when the doors are closed |
| $\overline{INSC}$ | Car is in-service with system processor |
| $\overline{INUP}$ | Intense up traffic-(per car signal) |
| $\overline{NUDGE}$ | Door held open for predetermined time |
| SLDN | Car slowing down |
| UPSV | Up service |
| UPTR | Up travel |
| $\overline{WT50}$ | |
| $\overline{WT75}$ | Car load exceeds 75% of capacity |
| $\overline{29}$ | Safety relay |
| $\overline{32L}$ | True when car is moving |

Figure 3:
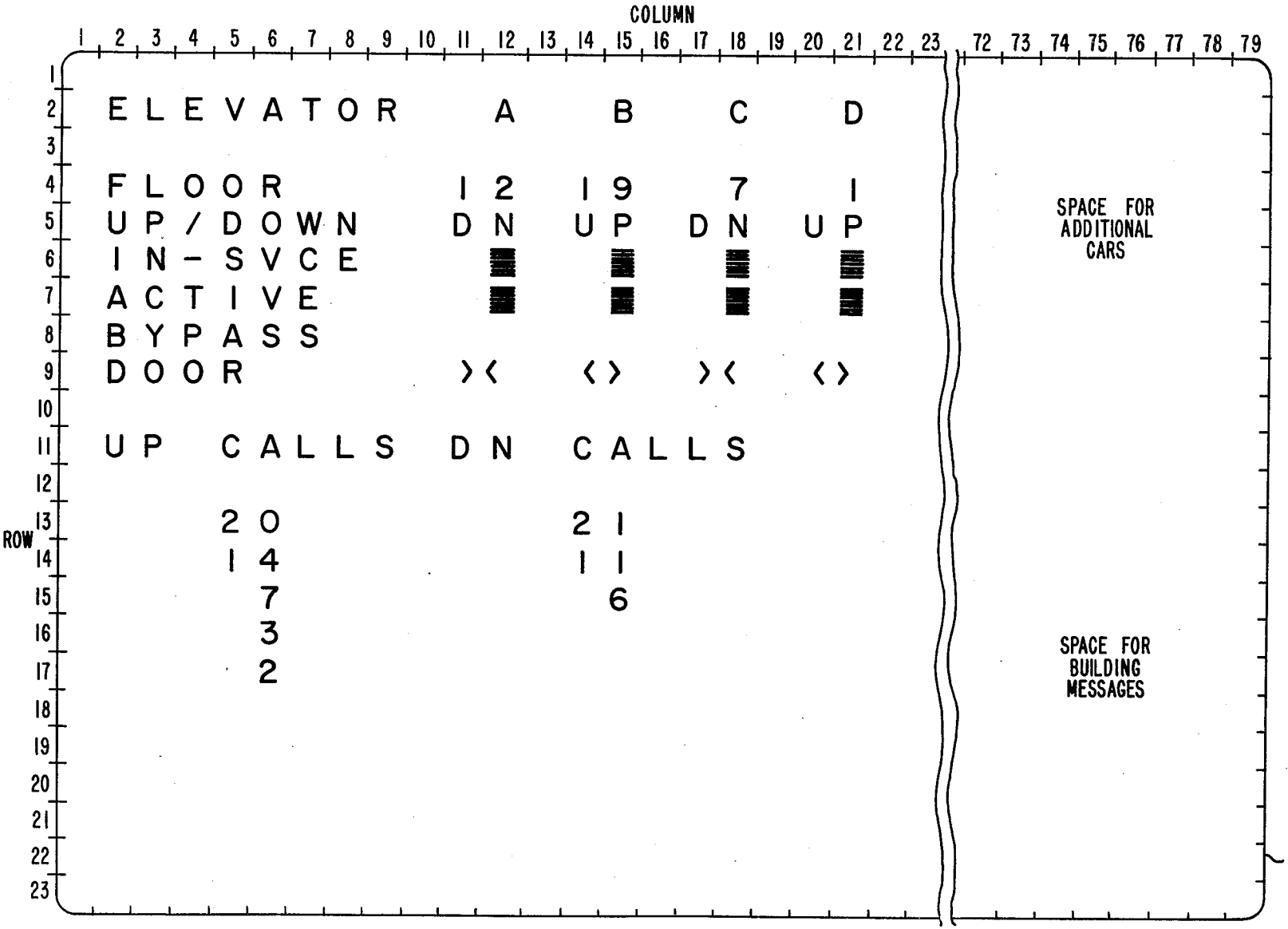
FIG. 3 is an elevational view of a video monitor which may be used in the display shown in block form in FIG. 1, which illustrates the display of hall calls according to an embodiment of the invention.

FIG. 1 illustrates TDS 60 with a video display 64 which includes a video RAM-display interface 90 and a video monitor 92. For purposes of example, it will be assumed that the video display interface 90 is the CRT controller MTX-2480, manufactured by MATROX Electronic Systems of Montreal, Quebec. The video monitor may be Model EVM-1410, manufactured by Electrohome Ltd., Kitchener, Ontario. The MTX-2480 has a 24×80 display field for displaying eighty columns and twenty-four rows of ASCII font characters. The display screen organization is illustrated in FIG. 3, with the characters set forth thereon illustrating a first embodiment of the invention. Representative per car data for four cars A, B, C and D is illustrated, as well as registered up and down hall calls.

Typical per car data may include: (a) the floor position of each car, developed from the advanced car position signal AVP0-AVP6; (b) the car travel direction developed from signals $\overline{DAD}$ and $\overline{DAU}$; (c) an in-service signal developed from signal $\overline{INSC}$; (d) an activity signal developed from signal AVAS, which indicates whether or not the car is active or available; (e) a bypass signal developed from signal BYPS, which indicates whether or not the car is bypassing hall calls; and (f) a car door signal developed from signal DRCL, which indicates whether or not the car doors are open or closed.

The up and down hall calls are developed from signals UPC and DNC, respectively. Unlike conventional call displays, a hall call for a specific floor is not tied to a particular location or device on the display. The display may thus be standarized. In a preferred embodiment, the present invention displays the currently existing hall calls in a predetermined order, and it stacks or compresses the calls such that they are uniformly spaced on the display. In other words, the spacing of the calls on the display bears no predetermined relationship to the spacing of the associated floors in the building. The number of hall calls and their locations may be determined at a glance, and the amount of space required on the display may be selected to be any desired size. It would also be suitable to display the calls in a predetermined order, without compression, displaying the calls at any location across the display space allotted for the calls. Then, when the number of displayed calls reached a point where compression is required, the compression step is automatically initiated.

FIG. 3 illustrates up and down hall calls displayed in separate listings. The separate listings may be separate columns on the display, as illustrated, or they may be displayed in separate rows instead of separate columns, as desired. The calls are displayed in numerical order, i.e., the order in which their associated floors appear in the building, and they may start with the highest call in the building at a predetermined row, such as row 13, and extend downwardly therefrom, as illustrated; or, they may start with the lowest call in the building at a predetermined row, such as row 23, and extend upwardly from this point, as desired. If the calls are horizontally displayed, i.e., displayed in rows, instead of in columns, they may start with the highest call, or the lowest call, at the lefthand side of the display, as desired.

FIG. 3A is a fragmentary view of the video monitor 92 shown in FIG. 3, illustrating still another arrangement for stacking and compressing hall calls. In this arrangement, both the up and down hall calls are displayed in a single list, such as a single column, as illustrated, with arrows indicating the service direction of the call. If up and down calls coexist from a specific floor, up and down arrows would both be displayed adjacent to this floor number.

While FIG. 3 illustrates a single listing for up calls and a single listing for down calls, it is to be understood that if the number of calls reaches the maximum number of allotted spaces in a specific list, that a new list may automatically be started adjacent to the associated list, with the predetermined order and predetermined uniform spacing being maintained in each listing of calls.

As illustrated in FIG. 3, the video monitor 92 has space for displaying information for additional cars. Further, the video monitor may be tied into the building security system, with a space on the display being maintained for displaying various building messages, such as a message that a predetermined door has been opened, a message that a predetermined fire alarm, smoke sensor and the like, has been tripped, etc.

Figure 4:
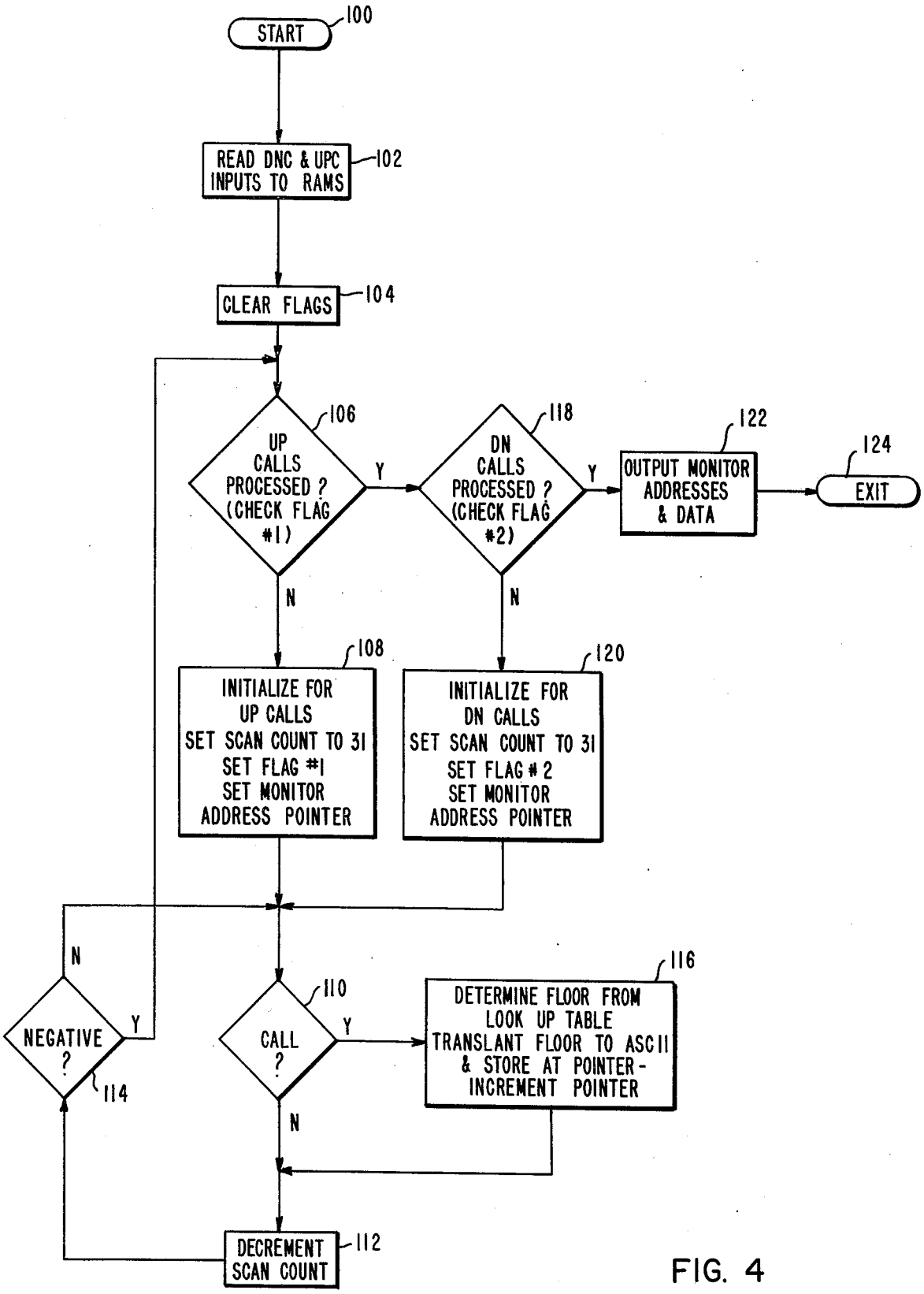
FIG. 4 is a flow chart which illustrates the basic steps of a program for displaying ordered, compressed calls on the video monitor shown in FIGS. 1 and 3.

FIG. 4 is a flow chart which, along with the RAM maps of FIGS. 5 and 6, will enable one skilled in the art to program a digital computer, such as Intel's 8080 microprocessor, to implement the teachings of the invention. The program developed from the flow chart would be loaded into the ROM 78 shown in FIG. 1. From the following description, it will also be apparent to one skilled in the art how calls may be stacked and compressed for displaying hall and/or car calls on segmented type alphanumeric displays, such as LEDs, and liquid crystal displays.

More specifically, when the data from the hall call control 50 shown in FIG. 1 is going to be transmitted to TDS 60 via data link LCTDS, a synchronization signal from the system processor will alert CPU 74 and the program of FIG. 4 will be entered at input 100. Step 102 reads the up and down hall calls UPC and DNC, respectively, into RAM 80, storing the information at predetermined addresses. FIG. 5 illustrates a look-up table stored in ROM 78 which relates the basic scan slots to floor levels, with the ROM map for this look-up table being displayed side-by-side with a RAM map illustrating the storage of the up and down hall calls, car calls, and car status signals contained in the data words in the data link LCTDS (FIG. 2). As hereinbefore stated, the information in data link LCTDS may be serially directed through input port 70, or it may be clocked through eight bits at a time, depending upon how long it is desired to tie the microprocessor up on input data transfer.

The serial format of the up and down hall calls UPC and DNC presents the calls in an ordered format, and thus the calls do not have to be sorted by an ordering routine. If the elevator system is of the type in which the calls are presented in a random order, the program would also include an ordering routine to order the calls in the desired format.

The storage of the up and down hall calls UPC and DNC starts at a predetermined address in RAM 80 and the address is incremented each scan slot.

Step 104 shown in FIG. 4 clears two program flags, identified as flags No. 1 and No. 2, which flags are provided to indicate when up and down calls, respectively, should be processed. step 106 determines if up hall calls have been processed by checking flag No. 1. If flag No. 1 is clear, up calls have not yet been processed, and if it is set, the up calls have been processed. The initial reference to step 106 will find flag No. 1 clear, and the program thus advances to step 108. step 108 initializes the program for processing up hall calls by setting a counter to the count of 31 (for a system with 32 basic scan slots). A program pointer is set to the RAM memory address at which the first up call found is to be stored. Flag No. 1 is set.

Step 110 determines if an up hall call is associated with scan slot 31. As illustrated in FIG. 5, scan slot 31 is not associated with a floor level, so the program advances to step 112 which decrements the scan count. Step 114 determines if the scan count has been completed. Since the scan count has not been completed at this point, the program returns to step 110 to determine if there is a call associated with this scan slot. Using the example of FIG. 1, the program will follow the cycle outlined in steps 112, 114 and 110 until scan slot 24 is reached, at which point an up hall call will be encountered. The program then advances from step 110 to step 116 which accesses the look-up table in ROM 78 shown in FIG. 5, to determine the floor level associated with scan slot 24. This table identifies the floor as floor No. 20. The floor number is translated to the associated ASCII font characters via another look-up table in ROM 78, and this information is stored at the address associated with the RAM memory pointer set in step 108. FIG. 6 illustrates a RAM map for storing the hall calls, with the RAM map illustrating the same calls which are displayed on the video monitor of FIG. 3. The monitor row and column address for placement of the first digit is 13 and 5, respectively, which in binary is row address 01101 and column address 0000101. The ASCII representation for "2" is 011 for the row address and 0010 for the column address. Two mode bits may also be set. If the mode bits are 00, as illustrated, the display will be normal. If they are set to 11, for example, the display at the selected location will blink. A timed out call, for example, may be indicated by blinking the floor number displayed relative to this timed out call.

The program will continue to process up calls in the same manner, compressing the five registered up calls from the 20th, 14th, 7th, 3rd and 2nd floors into adjacent memory addresses in RAM 80.

When step 114 finds all 32 scan slots have been examined for calls, the program returns to step 106 which checks flag No. 1 to see if up hall calls have been processed. Step 106 will not find flag No. 1 set, and the program advances to step 118 to determine if down calls have been processed. Step 118 will find flag No. 2 clear, and thus the program advances to step 120 to initialize the program for processing down hall calls. The scan count is set to 31, flag No. 2 is set, and an address pointer is set to the RAM memory address where the first down call encountered is to be stored. Steps 110, 112, 114 and 116 process all of the scan slots as hereinbefore described relative to up hall calls, resulting in the down hall calls from floors 21, 11 and 6 being stored in RAM 80, as illustrated in the RAM map shown in FIG. 6. The stored monitor addresses and associated data shown in FIG. 6 is then sent to the output ports in step 122, and the program exists at terminal 124. In a preferred embodiment, step 122 occurs at predetermined intervals, such as every 2 seconds, and thus instead of automatically performing step 122 at the completion of the updating program, it may be performed in response to a timer.

The embodiment of the invention set forth in FIGS. 1 through 6 relates to the display of up and down hall calls at a central monitoring point, such as TDS 60, and car calls may also be displayed on this same remote display, if desired. The program for displaying car calls on the display would be similar to the program for displaying hall calls. The invention is equally applicable to the display of car calls within the elevator car, as part of the car call station. The invention may be used as part of the car call station when there is a car call button for each floor, thus separating the pushbutton function from the display function. The display of car calls entered may thus be placed at a location and an elevation within the elevator car which is not blocked by other passengers. The separate stacked and compressed display of car calls may also be used when the button itself is illuminated to indicate a car call, in order to provide a separate display of car calls which is more readily visible to the passengers.

The invention is especially suitable for a car call station which includes a pushbutton array having fewer car call pushbuttons than the number of possible car calls which may be registered therefrom, such as by utilizing a predetermined procedure for entering the calls. Thus, each pushbutton is not specifically related to a specific car call, and the illumination of the button when actuated would provide no useful information.

Figure 7 is a fragmentary, elevational view of a car call pushbutton station 130 which may be used for the call input station 30 shown in FIG. 1. In the embodiment of FIG. 7, car calls for up to 59 floors, for example, may be entered via 15 pushbuttons, with 5 pushbuttons being located in the "tens" column, and 10 pushbuttons in the "units" column. A car call for the 11th floor would be entered by depressing button "1" in the tens column and button "1" in the units column. A temporary display 132 would display the call presently being entered. The call may be automatically entered a predetermined period of time after the last button is despressed, such as one or two seconds later. An error in call entry may thus be corrected during this time by depressing the clear button "C". This arrangement has the advantage of allowing the tens and units buttons to be actuated in either order. The circuitry may also be arranged to enter a call without a delay by arranging the call to be entered when the units button is actuated. With this arrangement, the tens button should be actuated first for car calls for floors 10 and above. When the call is entered into the system, the call number displayed on the temporary display 132 disappears, and this call is stacked and compressed in a display 134. As hereinbefore stated, instead of compressing the calls immediately, they may be placed in the proper order, but not compressed, until compression is necessary.

The position of the elevator car may be displayed in a separate display 136, or the car position may be made a part of display 134. For example, the car position may be the lowest number in the column for an up car, and the highest number for a down car. An appropriate legend identifying this location as the position of the car may be illuminated in response to the car travel direction.

An up car may be indicated on display 134 via an arrow 138 with the arrow being an upwardly directed arrow disposed at a selected location on the display. This arrow will then change to a downwardly directed arrow when the car is set for down travel. The format shown in FIG. 7 may be used for both an up and down traveling car, i.e., the car calls may always start at a predetermined selected end of the display, regardless of car travel direction. In a preferred embodiment of the invention, FIG. 7 illustrates the format for an up traveling car, and FIG. 8 illustrates the format of car call station 130 for a down traveling car. In other words, when the elevator car is set for up travel, the car calls preferably start at the bottom of the display, immediately above an upwardly directed arrow 138, and they are stacked, compressed, and listed in the order in which they will be served. When the elevator car is set for down travel, the up arrow 138 disappears and a downwardly directed arrow 140 appears at the top of the display. The car calls appear immediately below the downwardly directed arrow 140, and they are stacked, and compressed at the upper end of the display in the order in which they will be served by the elevator car. The number of positions in display 134 depends upon the size of the elevator car. A ten passenger car, for example, would provide a display having room for ten car calls.

Figure 9:
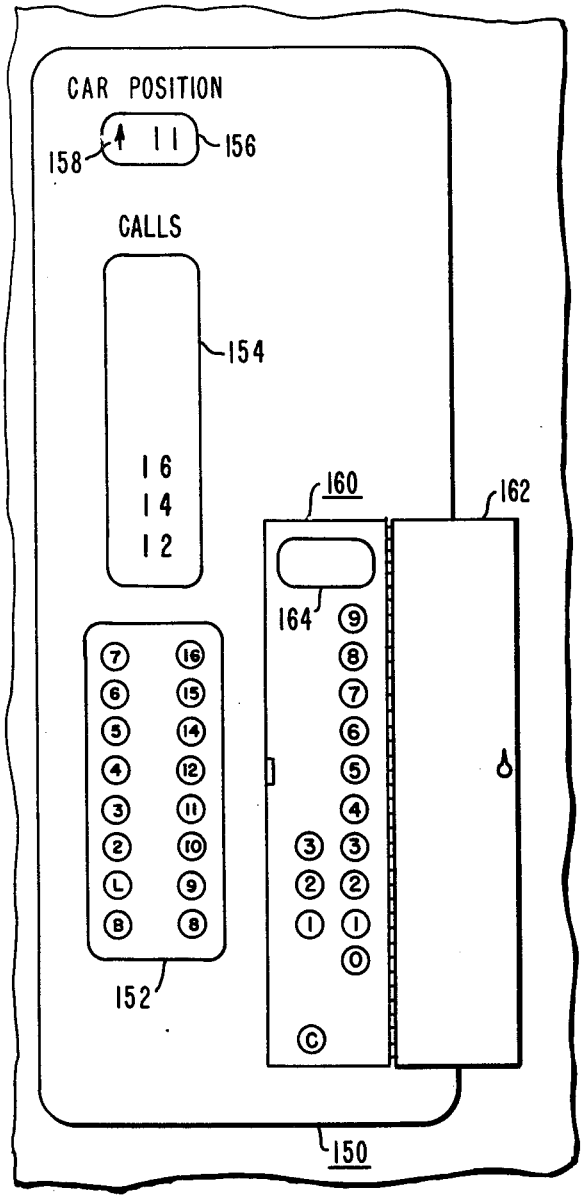

FIG. 9 is an elevational view of a car call station 150 constructed according to still another embodiment of the invention. In this embodiment, two separate call input stations 152 and 160 are utilized. The first call input station 152 is similar to the conventional pushbutton array wherein each pushbutton is associated with a specific floor level. The buttons may, or may not be illuminated, to indicate calls, as desired. The car calls entered on pushbuttons of station 152 are displayed via a display 154, with the floor numbers associated therewith being stacked and compressed in a predetermined order as described relative to the embodiment of FIGS. 7 and 8. The car position may be displayed in a separate display 156, with the car direction arrow 158 being associated therewith, or as hereinbefore pointed out, the car direction arrow may be a part of display 154, as may be the car position indicator.

The second call input station 160 associated with the car call station 150 includes an array of pushbuttons which may be mounted behind a locked door 162. This arrangement would be used when the elevator car associated therewith severs a predetermined block of floors for the general public, but is also available for use by authorized personnel to travel to other floors of the building. The second call input station 60 may include a "tens" column of pushbuttons, and a "units" column of pushbuttons, as hereinbefore described relative to FIG. 7, and a temporary display 164 for temporarily displaying a call being entered. A clear button "C" may also be provided, to clear an incorrectly entered call before it is registered as a car call.

The invention up to this point has been described relative to the display of hall calls and car calls remotely, in a TDS station, and relative to car calls in a car call station disposed within an elevator car. The invention is also applicable to displaying destination calls in the hallway. For example, instead of merely registering an up hall call, or a down hall call, a prospective passenger may enter his desired destination floor as an aid to the system processor in determining hall call assignments. This would make it unnecessary to provide a car call station within the elevator car, but one may be provided within the car as a backup in the event the passenger enters the car without making the selection of the destination floor in the hallway. A listing of destination floors is different than a car call listing, as a car call listing relates to a single car. The destination calls registered in the hallway may be associated with any one of a plurality of cars, depending upon which of the cars stops at the floor to serve a particular travel direction.

Figure 10:
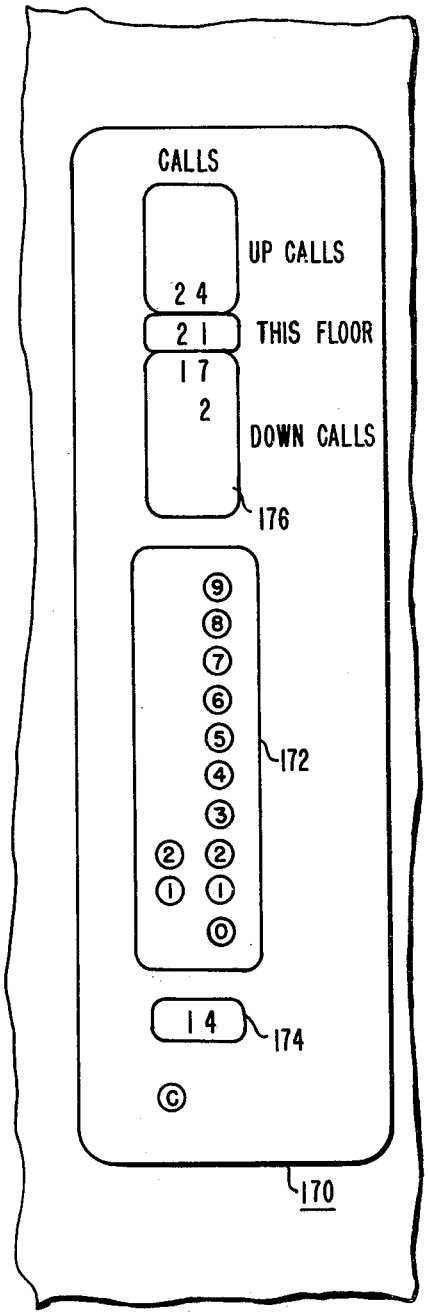

More specifically, FIG. 10 illustrates a hall call pushbutton station 170 which includes a pushbutton station or array 172, similar to the array 131 shown in FIG. 7. A "tens" column of pushbuttons is provided, along with a "units" column, and a separate temporary display 174 displays the calls selected. A clear button "C" may be provided for correcting errors before the call is actually entered into the system. A display 176 is provided for displaying the selected calls, with the display 176 preferably starting from the central portion of the display, which central portion identifies the floor level at which the display is located. A call entered on the pushbutton array 172 for a floor above this floor level will appear in the upper portion of the display, and a call entered for a floor position below this floor level will appear in the lower portion of the display. The displayed calls will be ordered and stacked as hereinbefore described. Up calls would start immediately above the floor number of the associated floor level, and down calls would start immediately below it, and they would be listed in the order in which these calls would be served as the car leaves the floor in the up and down directions, respectively. When a car stops at the floor to serve a specific service direction, the calls to be served by this car are removed from the display. For example, if a car stops at floor 21 to serve the down direction, calls for floors 17 and 2 would be removed from the display. These calls may be automatically transferred to a display located within the elevator car, since these hall calls are now car calls for this car.

In summary, there has been disclosed a new and improved elevator system, and a new and improved call display arrangement for an elevator system, in which the display function is separate from the call entering function. The calls are visually displayed in a predetermined order on a display which may be standardized since the display positions are unrelated to floor positions. In the preferred embodiment, the registered calls are compressed to provide a uniform physical spacing between the calls.

We claim as our invention:

1. An elevator system, comprising:

a building having a plurality of floors and hoistway means;

an elevator car mounted in the hoistway means of said building to serve the floors therein, call means for registering calls for elevator service, control means directing said elevator car to serve calls for elevator service, visual display means for displaying calls registered on said call means, said visual display means including means for displaying registered calls for elevator service in a predetermined order and with a predetermined uniform physical spacing between adjacent calls of the predetermined order, with said predetermined order and physical spacing between displayed calls being maintained as calls are registered on said call means and added to to the visual display, and as calls are answered by said elevator car and removed from the visual display.

2. The elevator system of claim 1 wherein the call means includes a plurality of pushbuttons located within the elevator car for registering car calls, and the display means is disposed within the elevator car.

3. The elevator system of claim 1 wherein the call means includes a plurality of pushbuttons located at the floors of the building for registering up and down hall calls, and the display means is located on a predetermined floor of the building.

4. The elevator system of claim 1 including a plurality of elevator cars mounted in the hoistway means of the building for serving the floors therein, wherein the call means includes a predetermined plurality of pushbuttons located at at least one of the floors arranged to enable a still larger plurality of calls for destination floors to be initiated therefrom, with the display means displaying the destination floors related to calls registered on the plurality of pushbuttons.

5. The elevator system of claim 4 wherein the predetermined order in which the registered hall calls are displayed on the display means is related to the order in which the destination floors will be served by the elevator car as it proceeds away from the associated floor to serve calls registered on the call means.

6. The elevator system of claim 1 wherein the call means includes pushbuttons located at the floors of the building for registering up and down hall calls, and the display means displays the up and down hall calls independently, with the up hall calls being displayed in the predetermined order and with the predetermined physical spacing, and with the down hall calls being displayed in the predetermined order and with the predetermined physical spacing.

7. The elevator system of claim 1 wherein the call means includes pushbuttons located at the floors of the building for registering up and down hall calls, and the display means displays the floor numbers associated with up and down hall calls in a single vertical column, in the predetermined order, and with the predetermined physical spacing, and including visual indicating means associated with each floor number which indicates whether the floor number displayed has an up hall call, a down hall call, or both.

8. An elevator system, comprising:

an elevator car mounted for movement in a building to serve the floors therein, call means in said elevator car for initiating car calls, display means in said elevator car for displaying car calls registered on said call means, and control means responsive to said call means for directing said elevator car to provide the requested service, said display means including display control means for displaying registered car calls in a predetermined order and with a predetermined physical spacing between adjacent calls of the predetermined order, said display control means updating the display means to add new calls registered on said call means, and to delete calls which are answered by said elevator car, maintaining said predetermined order and predetermined spacing relative to the updated display of car calls.

9. The elevator system of claim 8 wherein the predetermined order in which the display control means displays the car calls on the display means is the order in which the car calls will be served by the elevator car.

10. The elevator system of claim 8 wherein the predetermined order in which the display control means displays the car calls on the display means is the order in which the floors associated with the car calls are located in the building.

11. The elevator system of claim 8 wherein the call means includes a predetermined plurality of pushbuttons, and pushbutton control means arranged to enable the number of different car calls which may be registered on the call means to exceed said predetermined plurality of pushbuttons.

12. An elevator system, comprising:

a plurality of elevator cars mounted for movement in a building to serve the floors therein, call means at the floors for registering up and down hall calls, control means responsive to the call means for directing said elevator cars to serve registered hall calls, and a display panel for displaying registered up and down hall calls, said display panel including display control means for compressing the display of registered hall calls to provide at least one listing of registered calls having a predetermined order and predetermined uniform physical spaacing between calls.

13. The elevator system of claim 12 wherein the display control means compresses the display of registered hall calls into at least two listings of registered calls, with the up and down hall calls being in separate call lists.

14. An elevator system comprising:

an elevator car mounted for movement in a building to serve the floors therein, call means for initiating calls for elevator service, control means responsive to said call means for directing said elevator car to provide the requested service, and display means for displaying calls for elevator service initiated on said call means, said display means including first means for displaying calls for elevator service, with said first means having a plurality of display locations for such calls which locations may be used to display a call associated with any floor of the building, second means for displaying such calls on the first means in a predetermined order, and third means for providing a predetermined uniform spacing between adjacent calls of the order.

15. An elevator system, comprising:

an elevator car mounted for movement in a building to serve the floors therein, call means for initiating calls for elevator service, control means responsive to said call means for directing said elevator car to provide the requested service, and display means for displaying calls for elevator service initiated on said call means, said display means including first means for displaying calls for elevator service, with said first means having a plurality of display locations for such calls, said display locations being unrelated to specific floors, with each being capable of displaying a call associated with any floor of the building, and second means for selecting the display location for a specific call and for displaying the call on the first means in the selected location, said second means displaying a plurality of calls in a predetermined order, with the specific calls registered at any one time, and said predetermined order, being the basis for the selection by the second means of the specific display location for each call.

16. The elevator system of claim 15 wherein the call means is located within the elevator car for registering car calls, and the predetermined order is the order in which the calls for service will be served by the elevator car.

17. The elevator system of claim 15 wherein the call means includes a plurality of pushbuttons located at the floors for registering up and down hall calls, and the predetermined order is related to the relative positions of the hall calls in the building.

18. An elevator system, comprising:

an elevator car mounted for movement in a building to serve the floors therein, call means for initiating calls for elevator service, said call means including pushbuttons located at the floors of the building for registering up and down hall calls, control means responsive to said call means for directing said elevator car to provide the requested service, and display means for displaying calls for elevator service initiated on said call means, said display means including first means for displaying calls for elevator service, with said first means having a plurality of display locations for such calls which locations may be used to display a call associated with any floor of the building, and second means for displaying such calls on the first means in a predetermined order, said display means displaying the floor numbers associated with the up and down hall calls in a single listing, in a predetermined order, and with a predetermined physical spacing, and including visual indicating means associated with each floor number displayed which indicates whether the floor number displayed has an up hall call, a down hall call, or both.

19. An elevator system, comprising:

an elevator car mounted for movement in a building to serve the floors therein, call means for initiating calls for elevator service, said call means including pushbuttons located at the floors of the building for registering up and down hall calls, control means responsive to said call means for directing said elevator car to provide the requested service, and display means for displaying calls for elevator service initiated on said call means, said display means including first means for displaying calls for elevator service, with said first means having a plurality of display locations for such calls which locations may be used to display a call associated with any floor of the building, and second means for displaying such calls on the first means in a predetermined order, said display means displaying the up and down hall calls independently, with the up hall calls being displayed in a predetermined order and with a predetermined physical spacing, and with the down hall calls being displayed separately in a predetermined order and with a predetermined physical spacing.

20. An elevator system, comprising:

an elevator car mounted for movement in a building to serve the floors therein, call means for initiating calls for elevator service, control means responsive to said call means for directing said elevator car to provide the requested service, and display means for displaying calls for elevator service initiated on said call means, said display means including first means for displaying calls for elevator service, with said first means having a plurality of display locations for such calls which locations may be used to display a call associated with any floor of the building, second means for displaying such calls on the first means in a predetermined order, and third means for compressing the calls to provide a predetermined spacing therebetween, with said third means functioning at least when such compression is necessary to accommodate the calls in the space provided in the first means.

* * * * *